US005901594A

United States Patent [19]

Wasson et al.

[11] Patent Number: 5,901,594

[45] Date of Patent: May 11, 1999

[54] HIGH PRESSURE EXPANSION MANDREL WITH CAMS ENGAGING OPPOSITELY DIRECTED ENDS OF AN EXPANDABLE SEGMENTED RING

[75] Inventors: Russell D. Wasson, Florissant, Mo.; David A. Vossbrinck, Saratoga, Calif.

[73] Assignee: HydroPro, Inc., San Jose, Calif.

[21] Appl. No.: 09/010,205

[22] Filed: Jan. 21, 1998

[51] Int. Cl.[6] ..... B21D 39/08; B21D 22/10

[52] U.S. Cl. ..... 72/58; 72/62; 72/370.8; 72/370.22; 72/370.24

[58] Field of Search ..... 72/61, 62, 58, 72/370.08, 370.22, 370.24; 29/421.1

[56] References Cited

U.S. PATENT DOCUMENTS

| | | | |
|---|---|---|---|
| 2,460,580 | 1/1949 | Huber | 72/62 |
| 3,193,917 | 7/1965 | Looms | 72/58 |
| 3,986,383 | 10/1976 | Petteys | 72/370 |
| 4,414,739 | 11/1983 | Kelly | 29/727 |
| 4,450,612 | 5/1984 | Kelly | 72/62 |
| 4,467,630 | 8/1984 | Kelly | 72/62 |
| 4,502,308 | 3/1985 | Kelly | 72/58 |

*Primary Examiner*—David Jones
*Attorney, Agent, or Firm*—Jack M. Wiseman

[57] ABSTRACT

A high pressure mandrel for joining a metal tube to a wall of a metal sheet surrounding an annular bore of the metal sheet. The metal tube enters the bore of the metal sheet. The metal tube is joined to the metal sheet by high pressure fluid in an annular expansion gap by expanding radially the metal tube for forming a joint with the wall of the metal sheet surrounding the bore of the metal sheet. Toward this end, spaced O-rings are disposed on a shaft of a mandrel that is disposed axially in the metal tube. Outboard of the O-rings, backup rights are respectively disposed on the shaft. Outboard of the backup rings are disposed segmented ring assemblies which are also disposed on the shaft. Facing opposite ends of each segmented ring assemblies are cam rings. The cam rings are disposed on the shaft. High pressure fluid by means of a conduit provides a high pressure fluid to the inner wall of the metal tube to expand radially the metal tube to form a joint with the wall of the sheet of metal surrounding the bore formed in the metal sheet. Simultaneously therewith, the high pressure fluid urges the O-rings outwardly toward the associated backup rings, respectively. In turn, the backup rings are urged outwardly toward the associated segmented ring assemblies, respectively. Facing each of the segmented ring assemblies are cam rings. Each set of cam rings are disposed on the shaft. Each set of cam rings expand radially its associated segmented ring assembly in response to the high pressure fluid.

9 Claims, 4 Drawing Sheets

HIGH PRESSURE EXPANSION MANDREL WITH CAMS ENGAGING OPPOSITELY DIRECTED ENDS OF AN EXPANDABLE SEGMENTED RING

BACKGROUND OF THE INVENTION

The present invention relates in general to high pressure expansion mandrels and, more particularly, to a high pressure expansion mandrel for use in the radial expansion of a metal tube for providing a leak-proof joint between a metal tube and a sheet of metal.

In the patent to Kelly, U.S. Pat. No. 4,502,308, issued on Mar. 5, 1985, for Swaging Apparatus Having Elastically Deformable Members With Segmented Supports, there is disclosed a swaging mandrel to be inserted into a tubular structure that is radially expandable. A pair of seals define the axial boundaries of an annular pressure zone between the swaging mandrel and the tubular structure. The seals include an annular support formed by arcuate segments elastically held together. The annular support is formed at one end with a camming surface. At the other end of the annular support is a band which restrains axial movement of the annular support. At the one end of the annular support is a cam which engages the camming surface of the annular support to expand the annular support radially in response to swaging pressure.

The patent to Kelly, U.S. Pat. No. 4,414,739, issued on Nov. 15, 1983, for Apparatus For Hydraulically Forming Joints Between Tubes And Tube Sheets, discloses a mandrel. The mandrel includes an elongated, generally cylindrical body and a head. The mandrel is inserted into a tube that is positioned in the bore of a tube sheet. Pressurized hydraulic fluid is supplied through an axial passageway in the body that is continued by a cross-bore permitting hydraulic fluid to enter an annular volume between the body and the interior wall of the tube. The outer boundaries of the annular volume are between spaced O-rings which encircle the body.

SUMMARY OF THE INVENTION

An object of the present invention is to provide a high pressure expansion mandrel for use in the radial expansion of a metal tube in which a segmented ring assembly provides a more evenly distributed support for the inner wall of the metal tube during the radial expansion thereof.

Another object of the present invention is to provide a high pressure expansion mandrel for use in the radial expansion of a metal tube in which the extent of support between the inner wall of the metal tube and the mandrel is increased by axially spaced seals, back-up members, cams and segmented rings located at opposite ends of a shaft of the mandrel.

A feature of the present invention is that the high pressure expansion mandrel comprises a segmented ring with a camming surface at each end thereof and a cam at each end of the segmented ring engaging the adjacent camming surface of the segmented ring for providing a generally evenly distributed support for the inner wall of the metal tube during the radial expansion thereof and for providing greater uniformity in the axial direction and in the radial distance of the annular wall of the segmented ring to provide a more evenly distributed support for the inner wall of the metal tube during the expansion thereof.

Another object of the present invention is to provide a high pressure expansion mandrel for use in the radial expansion of a metal tube in which a segmented ring provides a uniform surface in the axial direction parallel to the axis of the mandrel for engaging the inner wall of the metal tube during the expansion thereof for reducing variations in the expanding stresses in the wall of the metal tube, resulting in greater strength, longer life, and reduced high pressure leakage for the metal tube.

Another object of the present invention is to provide a high pressure expansion mandrel for use in the expansion of a metal tube that is usable to expand metal tubes with a wider variation in the internal diameter of the metal tube.

Another feature of the present invention is that the high pressure expansion mandrel comprises a shaft and seals, back-up members, segmented rings, and cams located at each end of the shaft, respectively, at the high pressure end and at the low pressure end of the shaft to increase support for the extrusion gap coverage between the shaft of the mandrel and the wall of a metal tube during radial expansion of the metal tube.

DESCRIPTION OF THE PREFERRED EMBODIMENT

Figure 1:
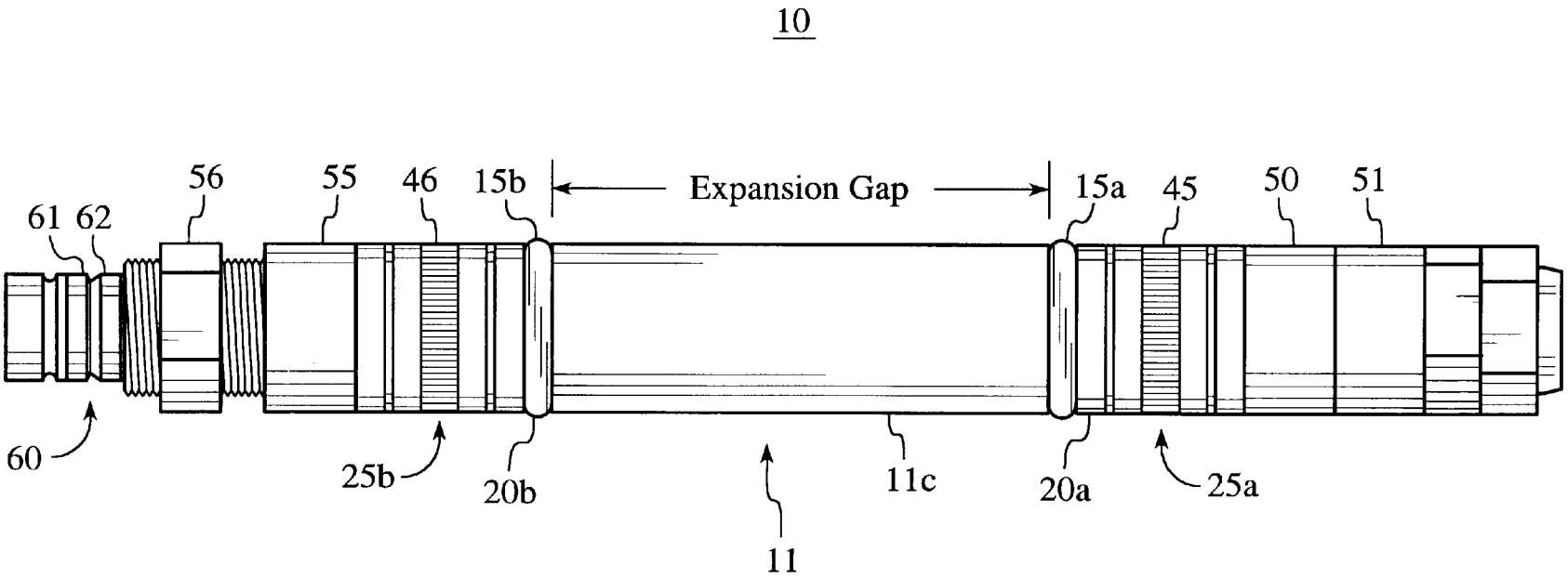
FIG. 1 is a front elevation view of the high pressure expansion mandrel embodying the present invention.
Figure 2:
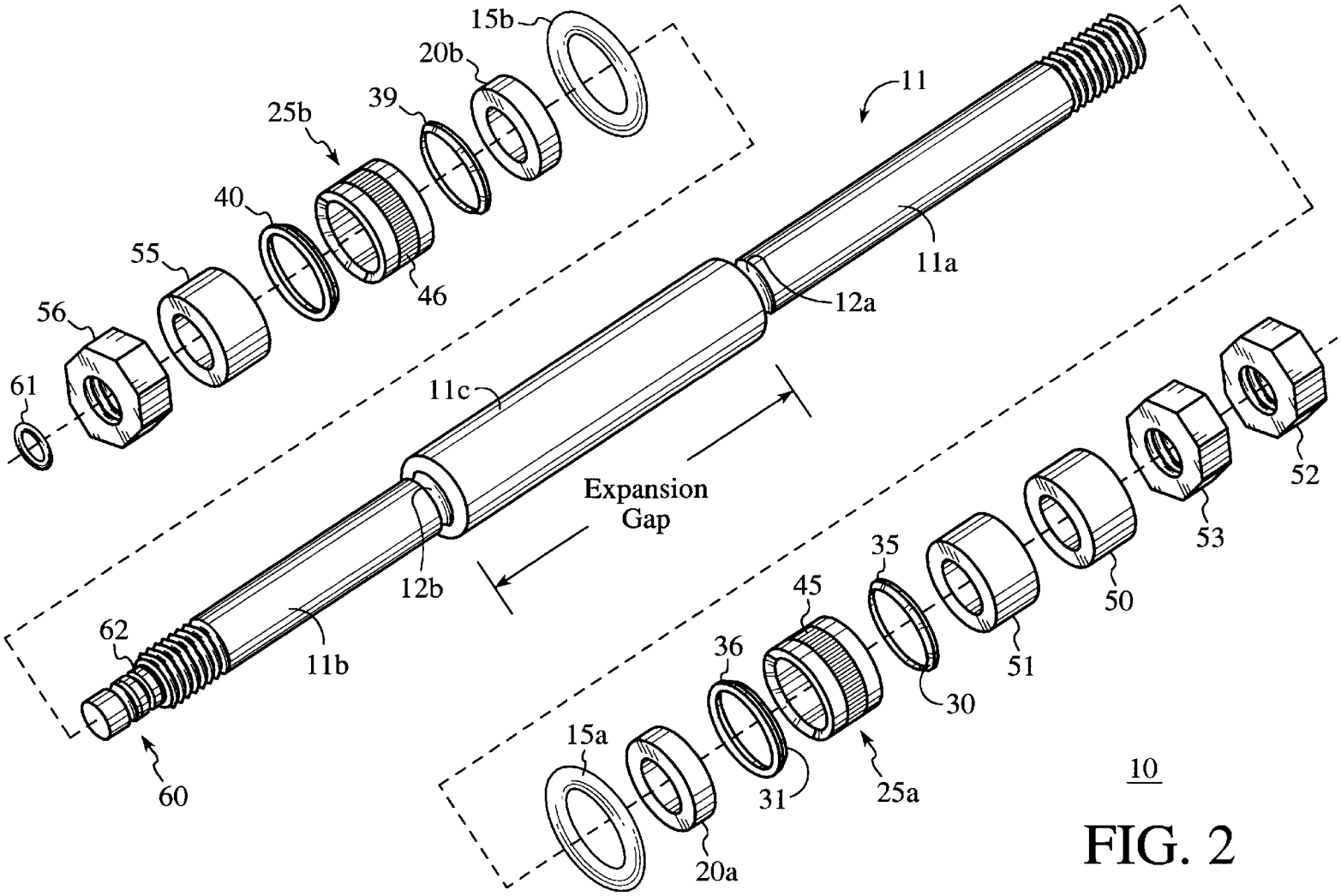
FIG. 2 is an exploded view of the high pressure expansion mandrel shown in FIG. 1.
Figure 3:
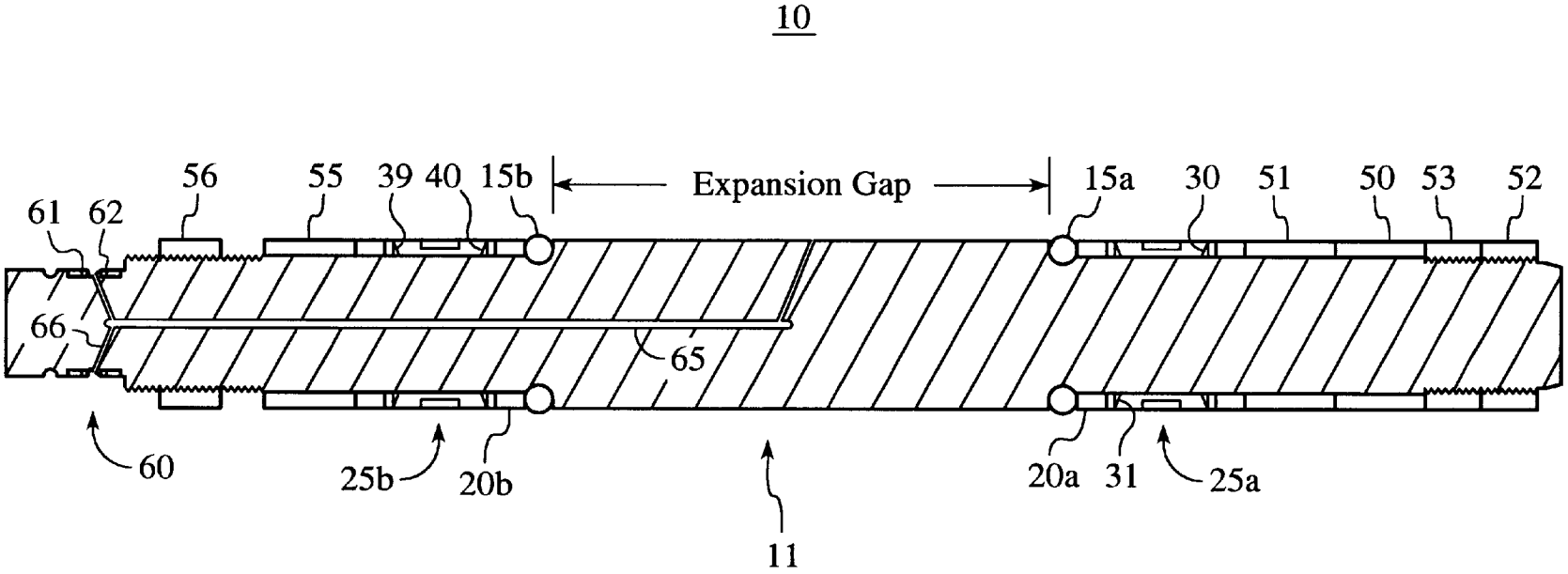
FIG. 3 is an axial sectional view of the high pressure expansion mandrel shown in FIGS. 1 and 2.
Figure 4:
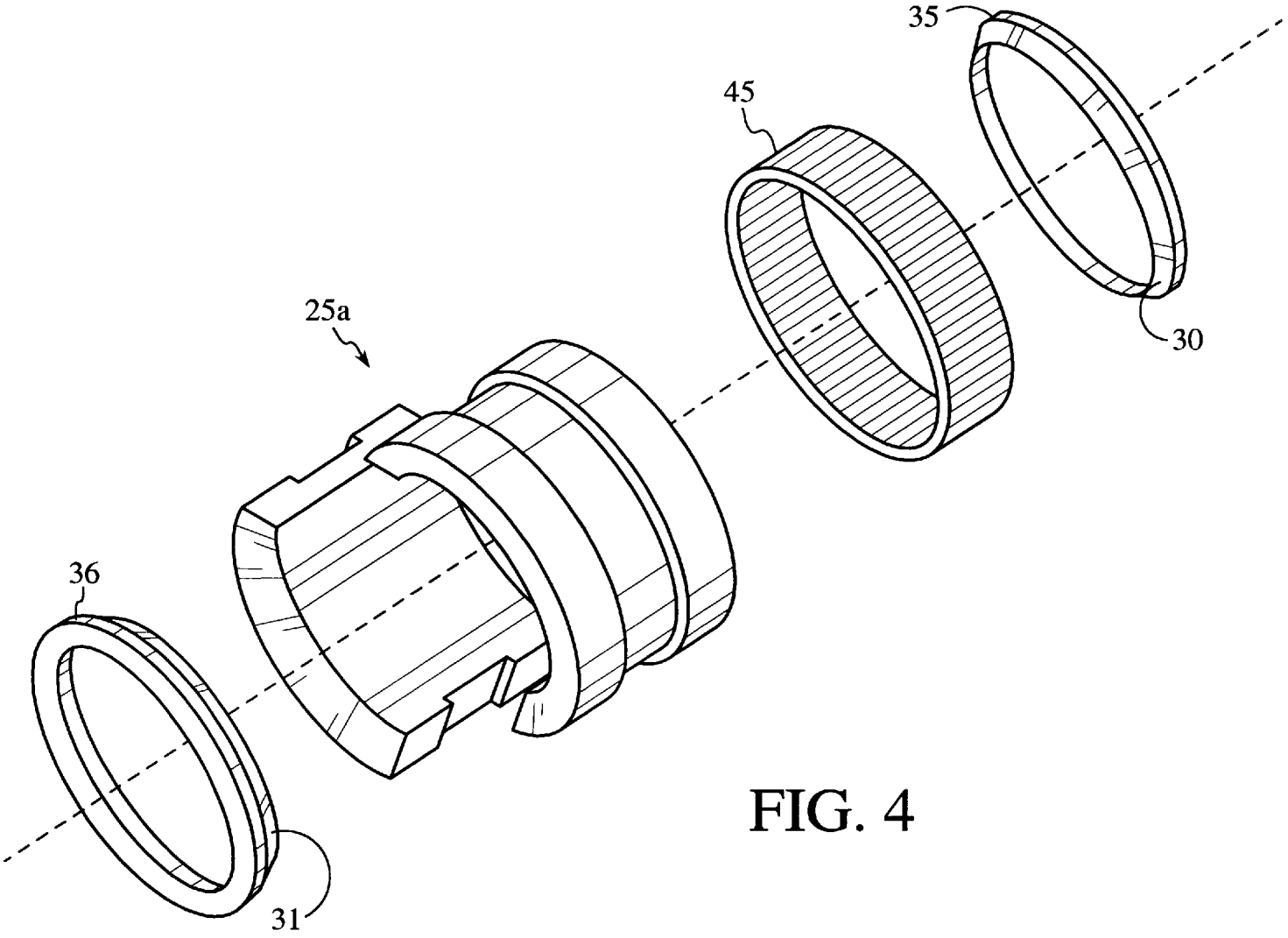
FIG. 4 is an exploded view of a segmented ring with a camming surface at each end thereof and a cam at each end of the segmented ring for engaging the adjacent surface of the segmented ring as incorporated in the high pressure expansion mandrel shown in FIGS. 1–3.

Illustrated in FIGS. 1–3 is a high pressure expansion mandrel 10 that is used, in the exemplary embodiment, to expand radially a metal tube, such as a steel tube, in the radial direction. The expansion mandrel 10 is inserted axially into a metal tube. The metal tube is disposed in a bore of a metal sheet, such as a sheet of steel. Hydraulic fluid, under pressure, enters the expansion mandrel 10 and leaves the expansion mandrel 10 to enter an annular extrusion or expansion gap between a solid shaft 11 of the expansion mandrel 10 and the inner wall of the metal tube for expanding the wall of the metal tube radially to form a leak-proof joint between the metal tube and the metal sheet.

In the exemplary embodiment, the fluid pressure in the annular extrusion and expansion gap up to 60,000 p.s.i. The fluid pressure in the annular extrusion or expansion gap expands the wall of the metal tube radially forming a leak-proof joint with the wall of metal sheet surrounding the bore of the metal sheet. The expansion of the wall of the metal tube closes a small clearance between the metal tube and the wall surrounding the bore of the metal sheet. The wall of the metal tube is enlarged by the radial expansion of the metal tube so that the metal tube forms a leak-proof joint with the metal sheet after the hydraulic pressure in the expansion gap is removed.

The shaft 11, in the exemplary embodiment, is made of stainless steel and has oppositely directed reduced diameter sections 11*a* and 11*b*. Suitable annular grooves 12*a* and 12*b* are respectively formed in the reduced diameter sections 11*a* and 11*b* adjacent the ends of the increased diameter section 11*c* of the shaft 11. Seated in the grooves 12*a* and 12*b*, respectively, are suitable seals of soft and resilient material or polyurethane O-rings 15*a* and 15*b*. The outer diameter of the O-rings 15*a* and 15*b* are slightly greater than the outer diameter of the increased diameter section 11*c* of the shaft 11 to form a fluid tight seal. An annular extrusion or expansion gap for the mandrel 10 is defined by the outer wall 11*c* of the shaft 11 and the inner wall of the metal tube when the mandrel 10 is inserted in the operative position of the metal tube to be expanded and extends in the axial direction along section 11*c* of the shaft 11, between the O-rings 15*a* and 15*b*.

The backup rings 20*a* and 20*b* are elastic seals made of polyurethane, in the exemplary embodiment, and serve to provide additional support for the O-rings 15*a* and 15*b*, respectively, to improve the seal at each end of the extrusion or expansion gap. The backup rings 20*a* and 20*b* tend to prevent destructive deformation to the O-rings 15*a* and 15*b*, respectively, and are located on the low pressure sides of the O-rings 15*a* and 15*b*. The high pressure sides of the O-rings 15*a* and 15*b* are located in the extrusion or expansion gap inwardly of the O-rings 15*a* and 15*b*. The backup rings 20*a* and 20*b* are considerably harder than the O-rings 15*a* and 15*b*, but will deform in a plastic manner at extremely high pressures. The backup rings 20*a* and 20*b*, when compressed axially by the force of the hydraulic fluid, will expand radially maintaining contact with the wall of the metal tube to be expanded to form the leak-proof joint with the wall of the metal sheet surrounding the bore thereof.

Outboard of the backup rings 20*a* and 20*b* are segmented ring assemblies 25*a* and 25*b*. On each side of the segmented ring assembly 25*a* are oppositely directed bevelled cam surfaces 30 and 31 of cam rings 35 and 36, respectively. Similarly, on each side of the segmented ring assembly 25*b* are oppositely directed bevelled cam surfaces 37 and 38 of cam rings 39 and 40. The bevelled cam surfaces 30 and 31 have contour conforming surfaces with the oppositely directed confronting walls of the segmented ring assembly 25*a*. Similarly, the bevelled cam surfaces 37 and 38 of the cam rings 39 and 40 have contour conforming surfaces with the oppositely directed walls of the segmented ring assembly 25*b*.

During expansion of the extrusion gap, the bevelled cam rings 35 and 36 expand radially the segmented ring assembly 25*a*. Similarly, during expansion of the extrusion gap, the bevelled cam rings 39 and 40 expand radially the segmented ring assembly 25*b*. During expansion of the annular extrusion gap, the segmented ring assemblies 25*a* and 25*b* remain parallel to the axis of the metal tube to be expanded radially to form a leak-proof joint with the wall of the metal sheet surrounding the bore thereof during the application of hydaulic pressure in the expansion gap. Thus, during the expansion of the extrusion gap, bending stresses are minimized. The segmented ring assemblies 25*a* and 25*b* are made of ultra high strength steel alloys. The bevelled cam rings 35, 36, 39 and 40 are made of ultra high strength alloys, such as a steel alloy.

Under extremely high pressure, the backup rings 20*a* and 20*b* could be deformed elastically and destructively into the expansion gap between the solid shaft 11 and the metal tube. The expansion gap is closed, however, by the segmented ring assemblies 25*a* and 25*b*, which form respective cylinders encircling the reduced diameter sections 11*a* and 11*b* of the solid shaft 11.

The segmented ring assemblies 25*a* and 25*b*, in the exemplary embodiment, comprise, respectively, six or eight segments held together by elastic bands or O-rings 45 and 46, respectively. The number of equal size segments for each segmented ring assembly is dependent on the size of the application. The O-rings 45 and 46 rest in grooves formed respectively in the outer annular face of the segmented rings of the segmented ring assemblies 25*a* and 25*b*. The segmented rings of the segmented ring assemblies 25*a* and 25*b*, respectively, are slidable along the reduced diameter sections 11*a* and 11*b*, respectively, and are disposed, respectively, at the ends of the shaft 11 confronting the backup rings 20*a* and 20*b*, respectively.

The cam rings 35 and 36 are annular members that are slidable along the reduced diameter section 11*a* of the shaft 11. The cam rings 39 and 40 are annular members that are slidable along the reduced diameter section 11*b* of the shaft 11. Each cam ring 35, 36, 39 and 40 has one end face thereof that is perpendicular to the axis of the shaft 11. Each of the cam rings 35, 36, 39 and 40 has an opposite bevelled end face, which faces its associated segmented ring assembly, conforming to or matching the bevelled surface confronting therewith. The angle of the opposite bevelled end face of the cam rings 35, 36, 39 and 40 will vary dependent on the force to be transferred from the hydraulic fluid to a cam ring and its associated segmented ring assembly to the inner wall of the metal tube to be joined with the wall surrounding the bore of the metal sheet.

At the heel end of the mandrel 10 adjacent the cam ring 35 are annular spacers 50 and 51. The spacers 50 and 51 assist in the positioning of the O-rings 15*a* and 15*b* on the metal tube to be joined with the metal sheet. The number of spacers employed is dependent on the thickness of the metal tube to be joined with the wall surrounding the bore of the metal sheet. Outboard of the spacers 50 and 51 are suitable locking nuts 52 and 53 for securing in threaded engagement the reduced diameter section 11*a* of the solid shaft 11 at the heel end of the mandrel 10.

Outboard of the cam ring 40 is disposed an annular spacer 55. The spacer 55 is disposed at the head end or the high pressure end of the mandrel 10. The spacer 55 assist in the positioning of the O-rings 15*a* and 15*b* on the metal tube to be joined with the wall surrounding the bore of the metal sheet. Outboard of the spacer 55 is a lock nut 56 that is secured in threaded engagement to the reduced diameter section 11*b* of the solid shaft 11 at the head end or high pressure end of the mandrel 10.

A suitable high pressure connector 60 of the solid shaft 11 provides the inlet port of the mandrel 10 up to 60,000 p.s.i. fluid pressure employed in the operation of the mandrel 10 for the expansion of the metal tube to be joined to the wall surrounding the bore of the metal sheet. O-rings 61 and 62 are disposed in recesses formed in the connector 60 of the shaft 11. For applying the high pressure fluid to the extrusion and expansion gap, a conduit 65 or a hole drilled into the solid shaft 11 (FIG. 3) extends from the connector 60 to the expansion gap area. A suitable barrier 66 encircles the conduit 66 at the connector 60 for directing the high pressure fluid through the conduit 65.

Upon the application of the high fluid pressure, the high pressure fluid enters the expansion zone to expand the metal tube to form a joint with the wall surrounding the bore of the metal sheet. In addition thereto, the high pressure fluid urges the O-ring 15*a* toward the backup 20*a*. This action urges the backup ring 20*a* to urge the camming surfaces 30 and 31 of the cam rings 35 and 36, respectively, into the contour conforming surfaces of the segmented ring assembly 25*a*. The spacers 50 and 51 with the nuts 52 and 53 maintain the cam ring 35 in camming contact with the segmented ring assembly 25*a*. Simultaneously, the high pressure fluid urges the O-ring 15*a* toward the backup ring 20*b*. The backup ring 20*b*, in turn, urges the camming surfaces 37 and 38 of the cam rings 39 and 40, respectively, into the contour conforming surfaces of the segmented ring assembly 25*b*. The spacer 55 and the nut maintain the cam ring 40 in camming contact with the segmented ring assembly 25*b*.

Thus, the mandrel shaft 11 of the mandrel 10 of the present invention is centered. The O-rings 15*a* and 15*b* are backed-up by the backup rings 20*a* and 20*b* and the segmented ring assemblies 25*a* and 25*b*. This is accomplished with minimum marking of the inner wall of the metal tubes. This is achieved through the segmented ring assemblies 25*a* and 25*b* and the cam rings 30 and 31 for the segmented ring assembly 25*a*, and the cam rings 39 and 40 for the segmented ring assembly 25*b*. During expansion of the metal tube for joining the wall surrounding the bore of the metal sheets, the segmented ring assemblies 25*a* and 25*b* remain parallel to the axis of the metal tube, thus minimizing bending stresses.

What is claimed is:

1. A high pressure mandrel for joining a metal tube to a wall of a metal sheet surrounding an annular opening of the metal sheet by high pressure fluid entering an annular expansion gap and expanding radially the wall of the metal tube to join the metal tube to the wall of the metal sheet surrounding the opening of the metal sheet, said high pressure mandrel comprising:

(a) shaft disposed axially in said metal tube;

(b) first segmented ring means disposed at an end section of said shaft, said first segmented ring means being segmented in the axial direction, said first segmented ring means having ends facing in opposite directions; and (c) first oppositely directed cam rings disposed on said shaft facing opposite ends of said first segmented ring means, respectively, said first cam rings expanding radially said first segmented ring means in response to the high pressure fluid.

2. A high pressure mandrel as claimed in claim 1 and comprising a first backup ring disposed on said shaft inboard of said first segmented ring means and said first cam rings.

3. A high pressure mandrel as claimed in claim 2 and comprising a first O-ring disposed on said shaft inboard of said first backup ring.

4. A high pressure mandrel as claimed in claim 3 and comprising second segmented ring means disposed at an end section of said shaft opposite to the end section of said shaft to which said first segmented ring means is disposed, said second segmented ring means being segmented in the axial direction, said second segmented ring means having ends facing in opposite directions, and oppositely directed second cam rings disposed on said shaft at the end thereof to which the second segmented means is disposed and facing opposite ends of said second segmented ring means, respectively, said second cam rings expanding radially said second segmented ring means in response to the high pressure fluid that enters the annular expansion gap.

5. A high pressure mandrel as claimed in claim 4 and comprising a second backup ring disposed on said shaft inboard of said second segmented ring means and said second cam rings.

6. A high pressure mandrel as claimed in claim 5 and comprising a second O-ring disposed on said shaft inboard of said second backup ring.

7. A high pressure mandrel as claimed in claim 6 wherein said shaft comprises a connector for receiving the high pressure fluid, said high pressure mandrel comprising a conduit communicating with said connector for applying high pressure fluid into said expansion gap for urging said first O-ring toward said first backup ring, for urging said first backup ring toward said first segmented ring means, and for urging said first cam rings into engagement with said first segmented ring means, for urging said second O-ring toward said second backup ring, for urging said second backup ring toward said second segmented ring means, and for urging said second cam rings into engagement with said second segmented ring means.

8. A high pressure mandrel as claimed in claim 7 and comprising a nut in threaded engagement with said shaft outboard of said first segmented ring means and said first cam rings.

9. A high pressure mandrel for joining a metal tube to a wall of a metal sheet surrounding an annular opening of the metal sheet by a high pressure fluid entering an annular expansion gap and expanding radially the wall of the metal tube to join the metal tube to the metal sheet, said high pressure mandrel comprising:

(a) a shaft disposed axially in said metal tube;

(b) a first segmented ring means disposed at one section of said shaft, said first segmented ring means being segmented in the axial direction, said first segmented ring means having ends facing in opposite directions;

(c) first oppositely directed cam rings disposed on said shaft facing opposite ends of said first segmented ring means, respectively, said first cam rings expanding radially said first segmented ring means in response to the high pressure fluid;

(d) second segmented ring means at another end section of said shaft, said second segmented ring means being segmented in the axial direction, said second segmented ring means having ends facing in opposite directions; and (e) second oppositely directed cam rings disposed on said shaft facing opposite ends of said second segmented ring means, respectively, said second cam rings being disposed on said shaft facing opposite ends of said second segmented ring means, respectively, said second cam rings expanding radially said second segmented ring means in response to the high pressure fluid.

* * * * *